US009102072B2

(12) United States Patent
Weber et al.

(10) Patent No.: US 9,102,072 B2
(45) Date of Patent: Aug. 11, 2015

(54) CUTTING BLADE THAT CAN BE ROTATIONALLY DRIVEN

(75) Inventors: Günther Weber, Zachow (DE); Matthias Kraft, Alt Kablich (DE)

(73) Assignee: Weber Maschinenbau GmbH & Co. KG, Breidenbach (DE)

( * ) Notice: Subject to any disclaimer, the term of this patent is extended or adjusted under 35 U.S.C. 154(b) by 1330 days.

(21) Appl. No.: 11/614,303

(22) Filed: Dec. 21, 2006

(65) Prior Publication Data

US 2007/0119285 A1 May 31, 2007

Related U.S. Application Data

(63) Continuation-in-part of application No. 10/495,006, filed as application No. PCT/EP02/12590 on Nov. 11, 2002, now abandoned.

(30) Foreign Application Priority Data

Nov. 9, 2001 (DE) ..... 101 55 048

(51) Int. Cl.
*B26D 1/00* (2006.01)
*B26D 1/12* (2006.01)

(52) U.S. Cl.
CPC ..... *B26D 1/0006* (2013.01); *B26D 2001/0046* (2013.01); *B26D 2001/0053* (2013.01)

(58) Field of Classification Search
USPC ..... 83/651, 663, 676, 703, 932, 665, 666; 30/276, 347, 348, 351, 355, 277.4, 30/263; 56/12.7, 295, 255, DIG. 7; 241/169.1, 282.1
See application file for complete search history.

(56) References Cited

U.S. PATENT DOCUMENTS

| | | | | |
|---|---|---|---|---|
| 742,000 | A | 10/1903 | Brooks | |
| 2,677,550 | A | 5/1954 | Berger | |
| 3,440,713 | A | 4/1969 | Henchert | |
| 3,452,794 | A | 7/1969 | Carl | |
| 4,845,929 | A * | 7/1989 | Kawasaki et al. | 56/17.5 |
| 5,094,065 | A * | 3/1992 | Azbell | 56/255 |
| 5,299,647 | A * | 4/1994 | Mudd et al. | 172/555 |
| 5,501,068 | A | 3/1996 | Martz | |
| 5,946,895 | A * | 9/1999 | Martens | 56/17.5 |
| 6,427,341 | B1 * | 8/2002 | Lee | 30/347 |
| 6,446,346 | B1 * | 9/2002 | Castleman | 30/276 |

FOREIGN PATENT DOCUMENTS

| | | |
|---|---|---|
| DE | 1108552 | 11/1955 |
| DE | 1842608 | 11/1961 |
| DE | 3932557 | 6/1990 |
| DE | 4037122 | 5/1992 |
| DE | 19502216 | 1/1996 |
| DE | 4431382 | 11/1999 |

* cited by examiner

*Primary Examiner* — Omar Flores Sanchez
(74) *Attorney, Agent, or Firm* — Gifford, Krass, Sprinkle, Anderson & Citkowski, P.C.

(57) ABSTRACT

The invention relates to a cutting blade that can be rotationally driven in which a stabilization area provided in the form of at least one bulge is provided between a central fixing area and an edge area whose outer periphery is provided in the form of a cutting edge.

9 Claims, 4 Drawing Sheets

Kreismesser mit Freiwinkel
Schneidposition 1
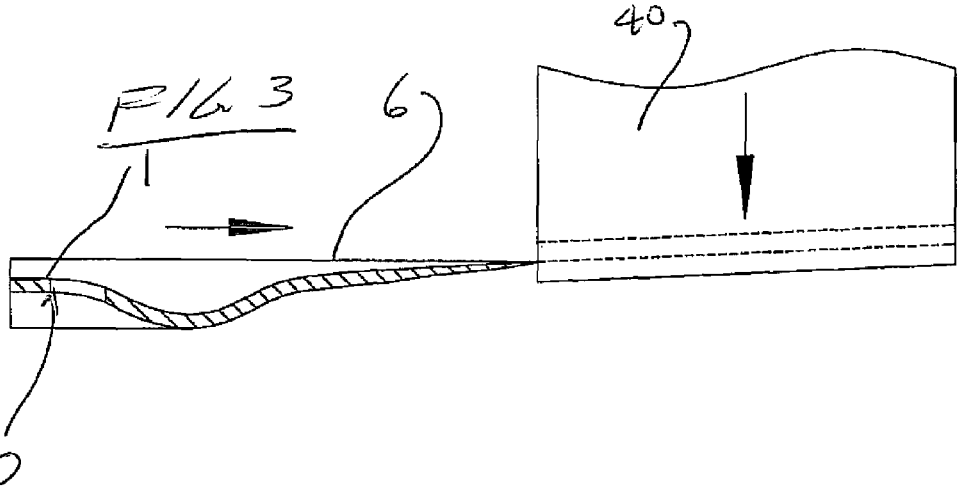
Schneidposition 2
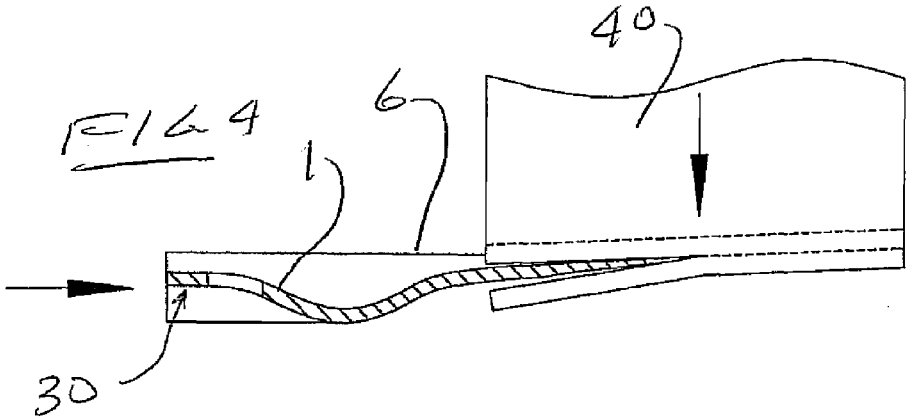
Schneidposition 3
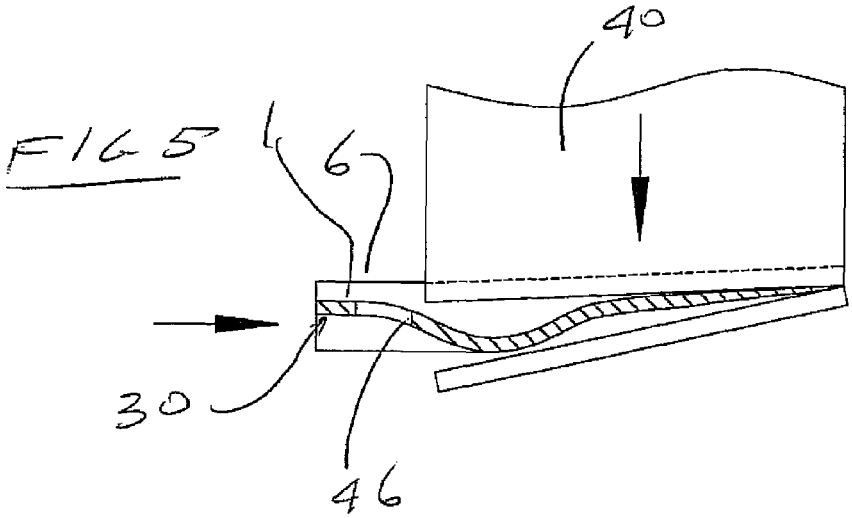

CUTTING BLADE THAT CAN BE ROTATIONALLY DRIVEN

CROSS-REFERENCE TO RELATED APPLICATIONS

This application is a continuation-in-part of U.S. patent application Ser. No. 10/495,006 filed Oct. 4, 2004, which is a 371 of PCT/EP02/12590 filed Nov. 11, 2002, which claims priority of German Patent Application No. 10155048.0 filed Nov. 9, 2001.

BACKGROUND OF THE INVENTION

I. Field of the Invention

The present invention relates to a cutting blade of the type used in food slicers.

II. Description of Related Art

Very high demands with respect to stiffness and strength are made on blades which are in particular used with so-called slicers for the slicing of food products such as ham, sausage, cheese and the like. These demands have the consequence that these blades have to be made in expensive manufacturing processes and have a relatively high weight.

SUMMARY OF THE INVENTION

It is the object of the invention to provide a blade for food slicers which is characterized by higher stiffness with simultaneously lower weight with respect to conventional blades and which can moreover be manufactured in a cost-favorable manner. The present invention further provides a blade offset which prevents import of the food product on the blade hub during a slicing operation.

This object is satisfied in accordance with the invention substantially in that a stabilizing zone in the form of at least one circularly extending arch is provided between the substantially planar central securing zone, which has at least one central opening, and a marginal zone whose outer periphery is made as a cutting edge.

The circularly extending arch, which is in particular designed in bead shape, results in a high stiffness of the blade with a comparatively low material strength and in no way impairs the marginal blade design, in particular the form of the cutting edge.

BRIEF DESCRIPTION OF THE DRAWING

An embodiment of the invention is described with reference to the drawing wherein:

FIGS. 3-5 are diagrammatic views illustrating the operation of the invention.

DETAILED DESCRIPTION OF A PREFERRED EMBODIMENT OF THE INVENTION

Figure 1:
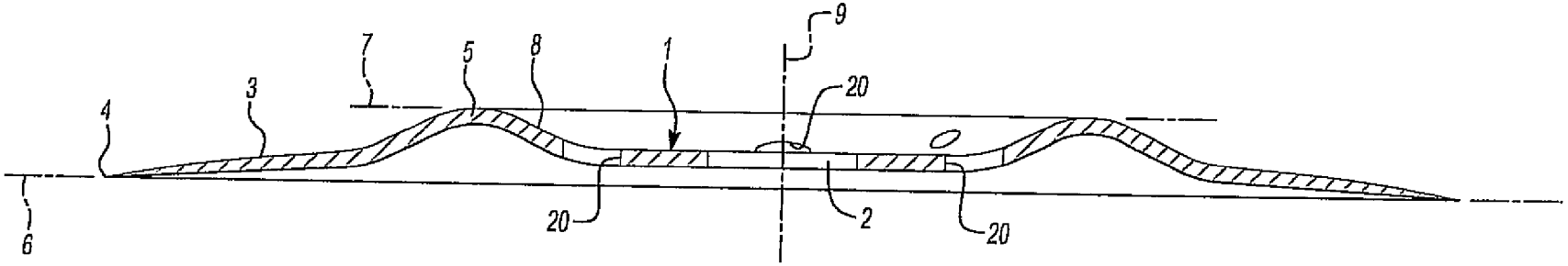
FIG. 1 is a sectional view of a preferred embodiment of the invention.

A blade 30 designed for use in slicers includes a central, substantially planar securing zone 1 having a central opening 2 with an axis 9. This opening 2 serves for securing purposes in the case of a circular blade and for centering in the case of a scythe-like blade, with a plurality of securing openings 20 arranged distributed around the opening 2 with a radial spacing from the opening 2 being provided with such a scythe-like blade as shown in FIG. 2.

Figure 2:
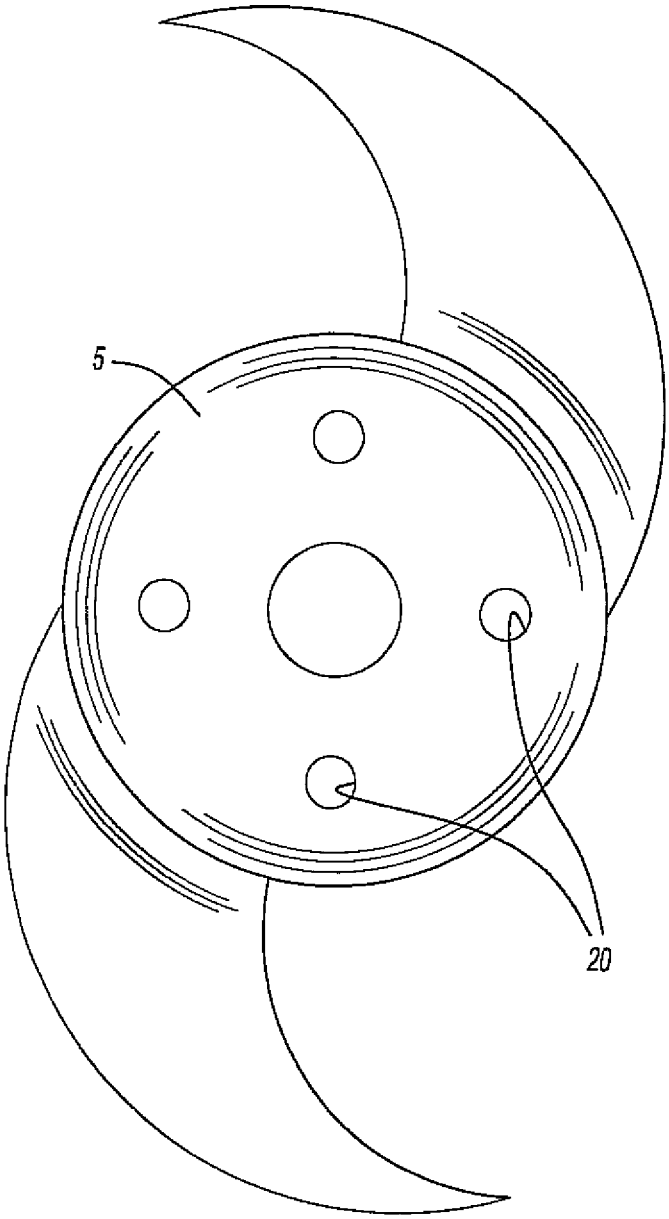
FIG. 2 is a plan view thereof.
Figure 6:
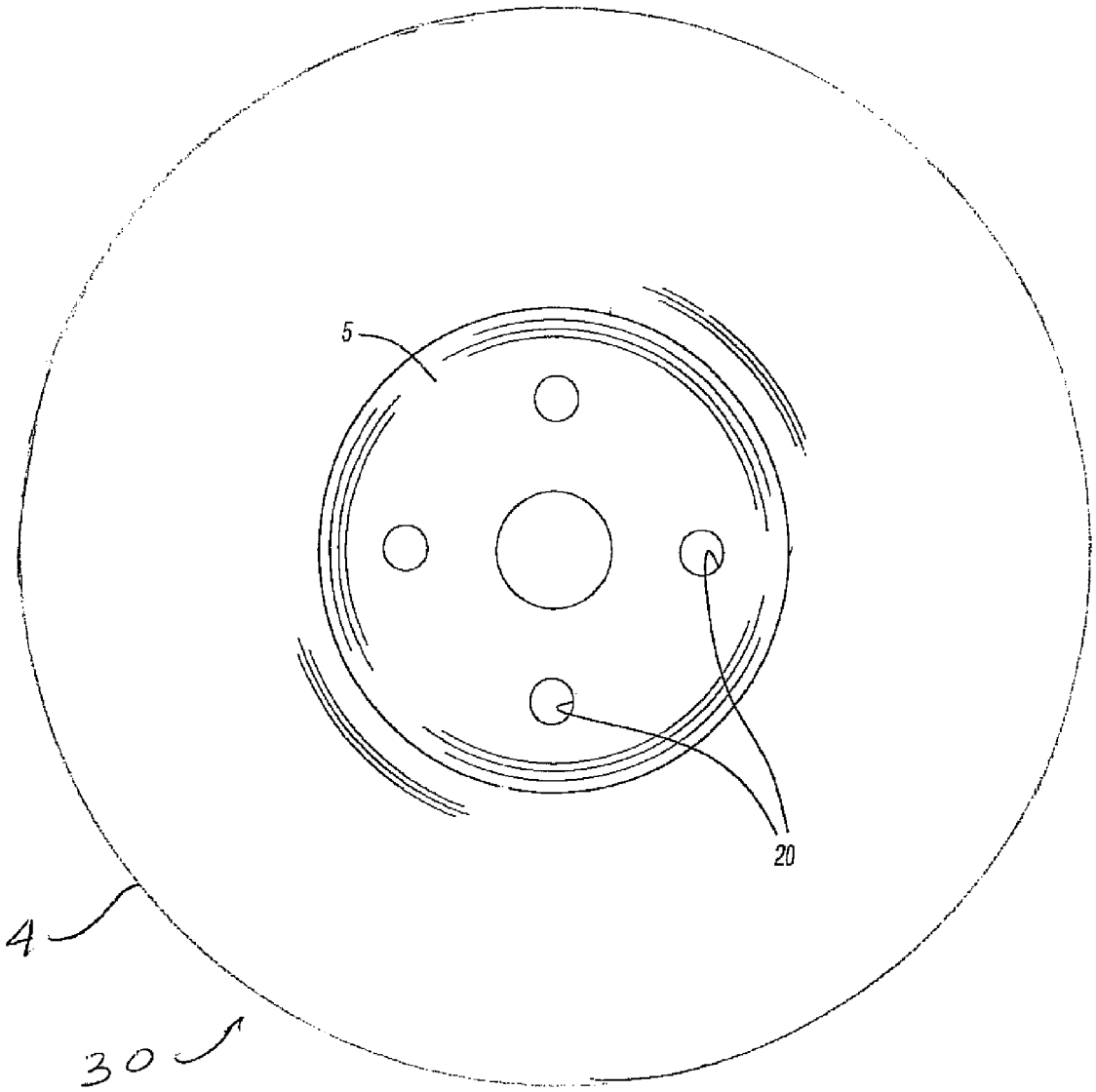
FIG. 6 is a view similar to FIG. 2, but illustrating a different configuration for the cutting blade in which the outer edge of the cutting blade is circular.

An exemplary scythe-like blade 30 is best shown in FIG. 2. The blade 30 includes an outer arcuate cutting edge 4 which performs the slicing cut of a food product upon rotation of the blade 30. Furthermore the entire cutting edge 4 lies in a base plane 6 (FIG. 1) which is perpendicular to the axis of rotation of the blade 30.

The central securing zone 1 merges radially outwardly through a transition region 8 into an arch 5 which forms a stabilizing zone. The arch 5, which is continuously curved in cross-section, surrounds the central securing zone 1 such that it lies in a depression in a practically recessed manner.

A marginal zone 3 radially outwardly adjoins the arch 5 and its periphery is made as a cutting edge 4. If, on the one hand, a base plane 6 is laid through the cutting edge 4 and a top plane 7 is laid through the apex of the arch 5, the central securing zone 1 is located between these two planes 6, 7, with the arch 5 and the inclination of the marginal zone 3 being selected with respect to the mentioned planes, which are parallel to one another such that, as a rule, the spacing of the central securing plane 1 is smaller with respect to the base plane 6 than with respect to the top plane 7.

The principle in accordance with the invention of the increase of the strength and stiffness of the blade with a simultaneous minimizing of the weight can be used both with blades whose cutting edge lies on a circle and with blades whose cutting edge extends in the manner of a scythe or over the periphery with an increasing radius.

With a ring-shaped arch 5 closed on itself, the scythe-like extent of the cutting edge can be achieved by a corresponding design of the marginal zone 3, but it is also possible to have the arch 5 follow the extent of the cutting edge over the periphery such that the marginal zone 3 also has a substantially similar radial extent over its periphery with a scythe-like blade.

As best shown in FIG. 1, the central securing zone 1 is spaced from the base plane of the cutting edge 4 by a distance greater than the material thickness of the blade 30. The central securing zone 1 is spaced from the top plane 7 so that the central securing zone is positioned between the top plane 7 and base plane 6. This construction provides several advantages.

First, this construction for the blade results in the center of gravity of the blade lying in substantially the same plane as the central securing zone 1. In practice aligning the center of gravity of the blade with the central securing 1 has been found to improve the cutting results for the slicing machine.

Secondly, and with reference to FIGS. 3-5, during a slicing operation the food product 40 is moved continuously toward the cutting blade 30 in the direction of arrow 42 from the position shown in FIG. 3 at the initiation of a slicing operation, through an intermediate cutting position shown in FIG. 4 and to the position shown in FIG. 5 at the end of the slicing operation. Consequently, by spacing the central securing zone 1 from the base plane 6 of the cutting blade, a collision or impact of the food product 40 against the central securing zone 1 at the end of the slicing operation is avoided as shown at 46 in FIG. 5.

The invention claimed is:

1. A rotatingly drivable cutting blade, in particular for apparatuses working with a high cutting sequence for the slicing of food products, comprising a substantially planar central securing zone (1) and an outer periphery serving as a cutting edge, with a stabilizing zone in the form of at least one circularly extending arch (5) being provided between the substantially planar central securing zone (1), which has at least one central opening (2), and a marginal zone (3) whose outer periphery is made as a cutting edge (4), said arch being continuously moved from the central securing zone and said marginal zone, characterized in that the arch (5) is formed in bead shape in cross-section and is continuously curved;

in that the cutting edge (4) is disposed in a base plane (6) forming the lower boundary of the cutting blade in the axial section of the cutting blade; and in that the plane of the central securing zone (1), considered in the axial direction, is disposed between the base plane (6) and a top plane (7) extending through the apex of the continuously curved arch (5), wherein the spacing of the central securing zone (1) from the base plane (6) and from the top plane (7) is in each case larger than the material thickness of the cutting blade to thereby prevent impact between the central securing zone and the food product during a slicing operation, and wherein the central securing zone (1), said arch (5) and said marginal zone (3) are dimensioned so that a center of gravity of the cutting blade is substantially coplanar with a plane perpendicular to an axis of rotation of said blade and which plane extends through a center of gravity of said central securing zone (1).

2. A cutting blade in accordance with claim 1, characterized in that the spacing of the central securing zone (1) from the base plane (6) is smaller than its spacing from the top plane (7).

3. A cutting blade in accordance with claim 1, characterized in that the marginal zone (3) extends toward the base plane (6) at an acute angle.

4. A cutting blade in accordance with claim 1, characterized in that the radial extent of the arch (5) approximately corresponds to the radial extent of the marginal zone (3).

5. A cutting blade in accordance with claim 1, characterized in that the outer periphery of the marginal zone (3) provided with the cutting edge (4) is circular.

6. A cutting blade in accordance with claim 1, characterized in that the arch (5) at least substantially follows the extent of the cutting edge in the peripheral direction of the blade with a cutting edge (4) extending in scythe-like shape.

7. A cutting blade in accordance with claim 1, characterized in that the arch (5) extends concentrically to the blade axis (9) with the cutting edge (4) extending in scythe-like shape.

8. A cutting blade in accordance with claim 6, characterized in that the central opening (2) forms a centering aperture; and in that securing openings are provided with a radial spacing from said centering aperture and are distributed around it.

9. A cutting blade in accordance with claim 7, characterized in that the central opening (2) forms a centering aperture; and in that securing openings are provided with a radial spacing from said centering aperture and are distributed around it.

* * * * *